US010164340B1

(12) United States Patent
Tonn et al.

(10) Patent No.: US 10,164,340 B1
(45) Date of Patent: Dec. 25, 2018

(54) BROADBAND MONOPOLE ANTENNA

(71) Applicants: David A Tonn, Charlestown, RI (US); Susan M Safford, Jamestown, RI (US)

(72) Inventors: David A Tonn, Charlestown, RI (US); Susan M Safford, Jamestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/704,251

(22) Filed: Sep. 14, 2017

(51) Int. Cl.

| | |
|---|---|
| ***H01Q 1/36*** | (2006.01) |
| ***H01Q 1/48*** | (2006.01) |
| ***H01Q 9/04*** | (2006.01) |
| ***H01Q 9/27*** | (2006.01) |
| ***H01Q 9/32*** | (2006.01) |
| ***H01Q 15/00*** | (2006.01) |

(52) U.S. Cl.
CPC ..... *H01Q 9/32* (2013.01); *H01Q 1/364* (2013.01); *H01Q 1/48* (2013.01); *H01Q 9/0407* (2013.01); *H01Q 9/27* (2013.01); *H01Q 15/0086* (2013.01)

(58) Field of Classification Search
None
See application file for complete search history.

(56) References Cited

U.S. PATENT DOCUMENTS

| | | | | |
|---|---|---|---|---|
| 4,246,586 | A * | 1/1981 | Henderson | H01Q 19/09 343/873 |
| 8,394,092 | B2 * | 3/2013 | Brannan | A61B 18/1815 606/34 |
| 9,407,010 | B1 * | 8/2016 | Tonn | H01Q 1/42 |
| 9,865,931 | B1 * | 1/2018 | Tonn | H01Q 13/22 |
| 2004/0017323 | A1 * | 1/2004 | Martiskainen | H01Q 1/242 343/792 |
| 2014/0104136 | A1 | 4/2014 | Werner et al. | |

* cited by examiner

*Primary Examiner* — Howard Williams
(74) *Attorney, Agent, or Firm* — James M. Kasischke; Michael P. Stanley

(57) ABSTRACT

An antenna capable of being joined to an antenna feed perpendicular to a ground plane includes a monopole extending perpendicularly from the ground plane. The antenna feed is joined to the monopole. An innermost shell is provided about the monopole. The innermost shell is made from a dielectric material having a dielectric tensor with high permittivity in the direction of the monopole axis. An intermediate shell provided outside the innermost shell. The intermediate shell also has dielectric tensor having high impedance in the direction parallel to the monopole axis. An outermost shell is provided having a perimeter approximately equal to the length of the monopole. The outermost shell also has a dielectric tensor with high impedance in the direction of the monopole axis.

20 Claims, 4 Drawing Sheets

BROADBAND MONOPOLE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

U.S. patent application Ser. No. 15/220,692 filed on Jul. 27, 2016 is incorporated by reference herein.

BACKGROUND OF THE INVENTION

(1) Field of the Invention

The present invention is directed to a monopole antenna having enhanced broadband characteristics.

(2) Description of the Prior Art

A focus of existing research has been modification of a simple monopole antenna operating near 2.5 GHz to obtain an octave of bandwidth. One solution for this is given by Werner et al. in United States Patent Publication No. 2014/0104136 A1, entitled "Broadband Monopole Antenna Using Anisotropic Metamaterial Covering." Their method works by surrounding the monopole antenna with an electrically thin layer of an engineered material having a non-isotropic dielectric tensor whose dominant axis is aligned with the z direction, the axis of the antenna inside. The material is indicated as having multiple resonances with at least one resonance above that of the uncoated monopole. In this antenna, the diameter of the engineered material cylinder is much smaller than the shortest wavelength of operation. It further indicates that the engineered material cylinder should be coaxial with the monopole. While it teaches that many cross-sectional shapes could be used for the engineered cylinder, only circular cylindrical structures are shown. Furthermore, only cylinders which completely cover the antenna along its entire length are taught.

It is suggested that bandwidth characteristics of a monopole can be improved by a variety of structures and means.

SUMMARY OF THE INVENTION

It is a first object of the present invention to provide a monopole antenna having improved bandwidth.

Another object is to provide such an antenna having an external shape that can conform to environmental installation requirements.

Accordingly, there is provided an antenna capable of being joined to an antenna feed perpendicular to a ground plane that includes a monopole extending perpendicularly from the ground plane. The antenna feed is joined to the monopole. An innermost shell is provided about the monopole. The innermost shell is made from a dielectric material having a dielectric tensor with high permittivity in the direction of the monopole axis, and a low permittivity in the plane orthogonal to the axis of the antenna. An intermediate shell provided outside the innermost shell. The intermediate shell also has dielectric tensor having high permittivity in the direction parallel to the monopole axis and a low permittivity in the plane orthogonal to the axis of the antenna. An outermost shell is provided having a perimeter approximately equal to the length of the monopole. The outermost shell also has a dielectric tensor with high permittivity in the direction of the monopole axis and a low permittivity in the plane orthogonal to the axis of the antenna.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
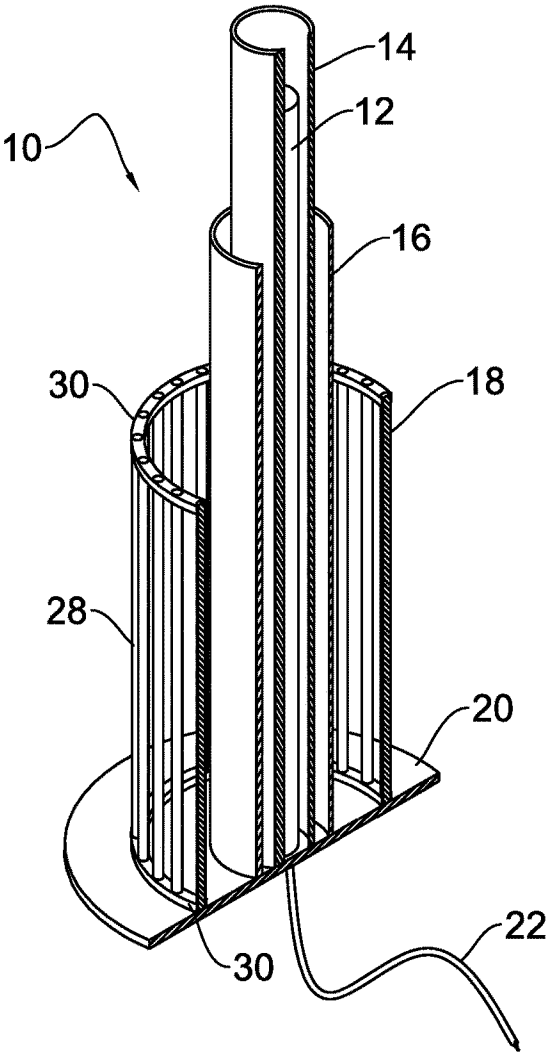
FIG. 1 is a cut away perspective view of a first embodiment of the antenna.

FIG. 1 depicts a cut away view of an antenna 10 in accordance with a first embodiment of the invention. Antenna includes a central monopole 12 surrounded by a series of shells 14, 16 and 18 of anisotropic dielectric material. In this embodiment, each of the shells 14, 16, or 18 is cylindrical in cross section and sits on a ground plane 20. Monopole 12 is joined to a feed 22.

The axes of the shells 14, 16, and 18 are perpendicular to the surface of the ground plane 20. Each of the shells 14, 16 or 18 has a different radius and can have a different thickness and be made from a material having different dielectric properties; however, there may be instances in which two or more of the shells are composed of the same material. In this embodiment, the innermost shell 14 extends just beyond the height of the monopole 12 inside. Intermediate shell 16 is shorter in height than innermost shell 14. Outermost shell 18 is shorter than intermediate shell 16. Outermost shell 18 has a circumference that roughly equals the length of monopole 12.

Theoretically, innermost shell 14 aids monopole 12 at the lower end of the operating band, since it covers the length of the entire monopole. Intermediate shell 16 aids mid-band, where less of monopole 12 is active. Outermost shell 18 can be the shortest since a shorter region of the central monopole is active. Active means contributing to the radiation effect. As frequency increases, wavelength decreases and so does the effective length of the monopole. By having shorter shells, this arrangement reduces the material required for the shells and also reduces the physical profile of the antenna allowing this embodiment to fit within a tapered radome. It has been found that a plurality of shells allow tailoring and broadening of monopole 12's bandwidth, and that these shells need not be comprised of the same material, nor be of a height that completely envelops the monopole inside.

Each of the anisotropic shells is comprised of an anisotropic material having a diagonal dielectric tensor where only one of the components is greater than unity. In this case, that component is in the z direction so as to be parallel with the axis of monopole 12. This anisotropic material is characterized by a relative permittivity tensor:

$$\bar{\varepsilon}_r(\omega) = \begin{bmatrix} \varepsilon_{xx} & 0 & 0 \\ 0 & \varepsilon_{yy} & 0 \\ 0 & 0 & \varepsilon_{zz} \end{bmatrix} \quad (1)$$

where the material is considered to be highly anisotropic if one of the diagonal elements in the tensor is greater than the other two by a factor of at least eight to ten. In other words, these shells should be made from a dielectric material having a dielectric tensor with high permittivity in the direction of the monopole axis, and a low permittivity in the plane orthogonal to the axis of the antenna.

Figure 2A:
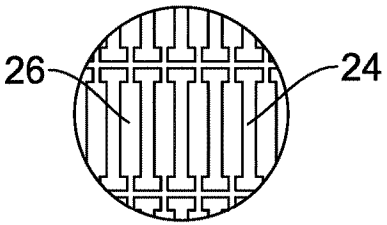
FIG. 2A shows a first embodiment of an anisotropic material.
Figure 2B:
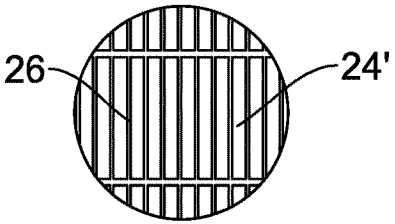
FIG. 2B shows a second embodiment of an anisotropic material.

As shown in FIG. 2A and FIG. 2B, this material can be implemented as an array of conductive stripes 24 in FIG. 2A and 24' in FIG. 2B deposed on a dielectric material 26. In FIG. 2A, conductive stripes 24 have horizontal portions at the ends of the vertical portion. In FIG. 2B, stripes 24' are vertical stripes. In one embodiment, the length-to-width ratio of the stripes gives them a static polarizability of approximately 10 times that of free space, satisfying the definition of an anisotropic material. This material is utilized at frequencies well below its resonance frequency.

FIG. 1 shows an embodiment using an array of high dielectric constant rods 28 as shown in outermost shell 18 as the anisotropic material. Rods 28 are retained in a cylindrical configuration by holder 30. Other retaining apparatus can be used. For example, rods 28 can be embedded in a solid material.

It is also preferred that shells 14, 16, and 18 be strongly polarizable in one direction relative to the other two directions by a factor greater than or equal to approximately 5:1. This polarizable direction should be oriented parallel to the axis of monopole 12 for all shells in use.

A prototype of the first embodiment of antenna 10 was tested. In this prototype, monopole 12 is 1.25 inches in diameter and 22 inches long. Monopole 12 is fed by feed 22 above a 10 inch diameter aluminum ground plane 20 by a C-type coaxial connector beneath ground plane 20. Three shells 14, 16 and 18 are positioned about monopole 12. Innermost shell 14 is 2 inches in diameter and 24 inches long. This shell 14 was formed using a sheet of copper I-shapes printed on a polyethylene substrate as the anisotropic material. This shell material is shown in FIG. 2A. The I-shapes 24 are 9/16 inches tall by 1/8 inches at the base. The conductive strip is 1/16 inches wide. The shapes are separated by 1/32 inches. This material was used in the prototype used to create the graph of FIG. 4. FIG. 2B shows a sheet having straight vertical stripes 24' with similar dimensions. This pattern is also believed to be effective. Anisotropic material sheets could be formed in different patterns. For example conductive shapes could be "J" shapes, "T" shapes or other shapes that are longer in the vertical direction than in the horizontal direction.

The sheet is wrapped around a plastic tube to give it form, and the tube is cemented to ground plane 20 with epoxy. Intermediate shell 16 uses two sheets of copper I-shapes with one sheet positioned on the exterior of a polyvinylchloride pipe with a wall thickness of 1/8" and the other sheet positioned on the interior of the pipe. Intermediate shell 16 is 18 inches long and 3 inches in diameter. Outermost shell 18 is 6.5 inches in diameter and is composed of an array of zirconium oxide rods 28 having a dielectric constant of about 30 arranged in a regular circular array. Each rod is 1/4 inch in diameter and 12 inches long. The rods are spaced 15 degrees of arc apart around the circumference of the 6.5 inch outermost shell 18 diameter. (Note that this arrangement gives an outer diameter of 7" to the rod array, making its circumference approximate the 22" length of the monopole inside.) To hold the rods 28 in place, holders 30 made from low dielectric constant (~1.5) syntactic foam are used.

Figure 3:
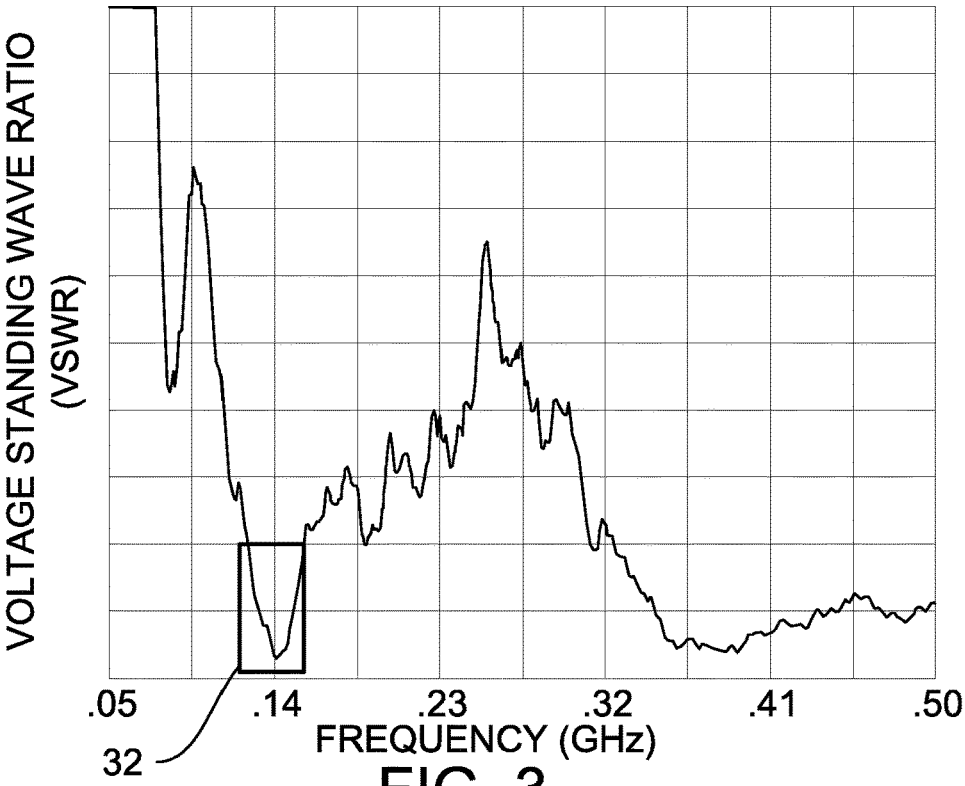
FIG. 3 is a graph of VSWR versus frequency for a prior art monopole antenna.
Figure 4:
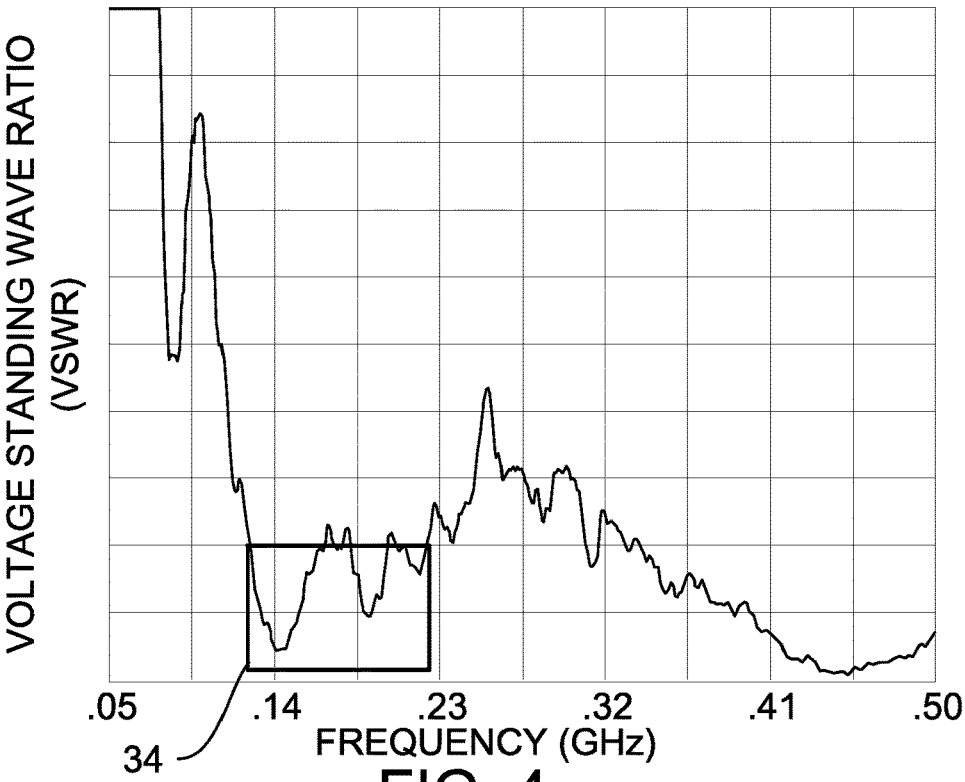
FIG. 4 is a graph of VSWR versus frequency for the first embodiment of the antenna.

Data on the voltage standing wave ratio (VSWR) are presented in FIG. 3 and FIG. 4. FIG. 3 shows the VSWR for the monopole alone. Box 32 indicates the primary pass band for the monopole antenna. FIG. 4 provides the VSWR for the prototype antenna shown in FIG. 1. Box 34 provides the primary pass band for the antenna according to this embodiment. This analysis shows that modification as shown by the prototype of FIG. 1 effectively tripled the bandwidth of the monopole antenna.

Experimentation has shown that the number of shells needed appears to depend on the diameter of the inner monopole. In the case of a small diameter monopole, more shells need to be positioned within the outermost shell to obtain improved bandwidth. With a larger diameter monopole, fewer are needed. It is theorized that this is caused by the higher amounts of reactive stored energy in the smaller diameter monopoles.

Figure 5:
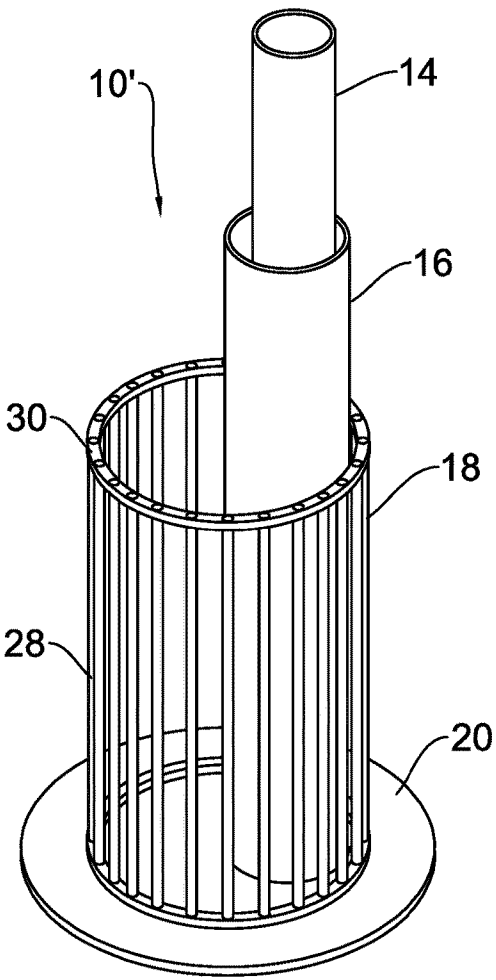
FIG. 5 is a perspective view one embodiment of a second embodiment of the antenna.

An alternative embodiment shown in FIG. 5 has also been tested. In this embodiment of the antenna 10', innermost shell 14 and intermediate shell 16 are offset from monopole (not shown) inside innermost shell 14. Likewise, outermost shell 18 is offset from intermediate shell 16. Thus, the central axes of shells 14, 16 and 18 do not coincide with that of monopole. Upon testing, it was found that the VSWR response of antenna 10' of FIG. 5 is not significantly different from the case where the shells are all centered on the monopole, antenna 10 of FIG. 1. This is significant since it indicates that this approach is tolerant of manufacturing errors/offsets/tolerance stack-up.

Figure 6:
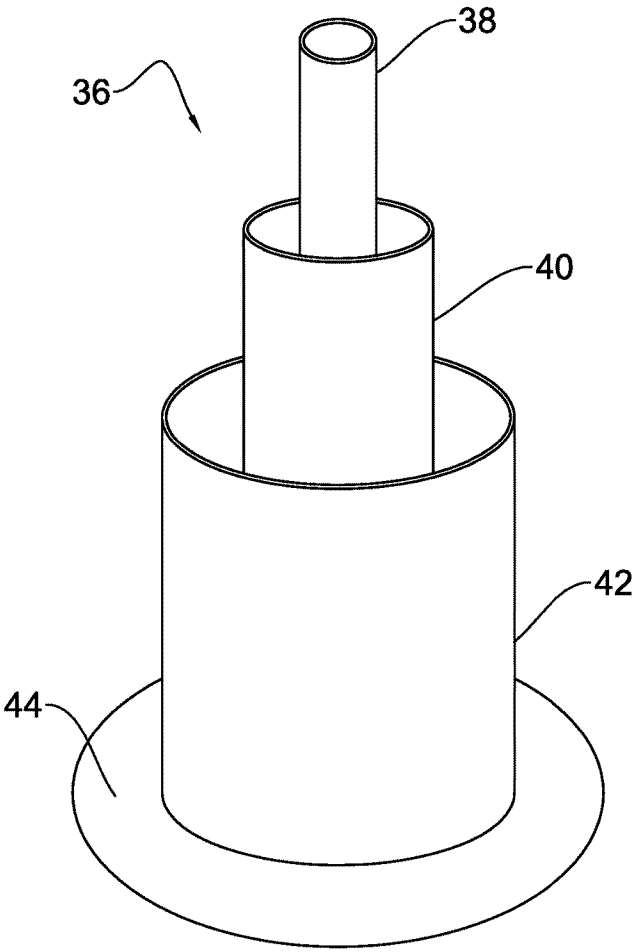
FIG. 6 is a perspective view of a third embodiment.

FIG. 6 provides another alternate embodiment of an antenna 36. As in the previous embodiment, monopole is surrounded by innermost shell 38. In this embodiment, intermediate shell 40 and outermost shell 42 have an elliptical cross-section instead of the circular cross-section shown in the first embodiment. Outermost shell 42 is further pictured as a shell having an anisotropic layer rather than the rod array shown in FIGS. 1 and 5. Monopole and shells 38, 40, and 42 are positioned above a ground plane 44.

The shells are not required to be circular cylinders but can be any shape such as an elliptical cylinder. It is believed that the same broadband behavior can be obtained when the cross section is elliptical, rectangular, or most any simple smooth closed curve. One requirement, however, is that the shells must remain right cylinders with their axes parallel to each other and normal to the ground plane. The perimeter of the outermost shell needs to be approximately equal to the length of the monopole.

Figure 7:
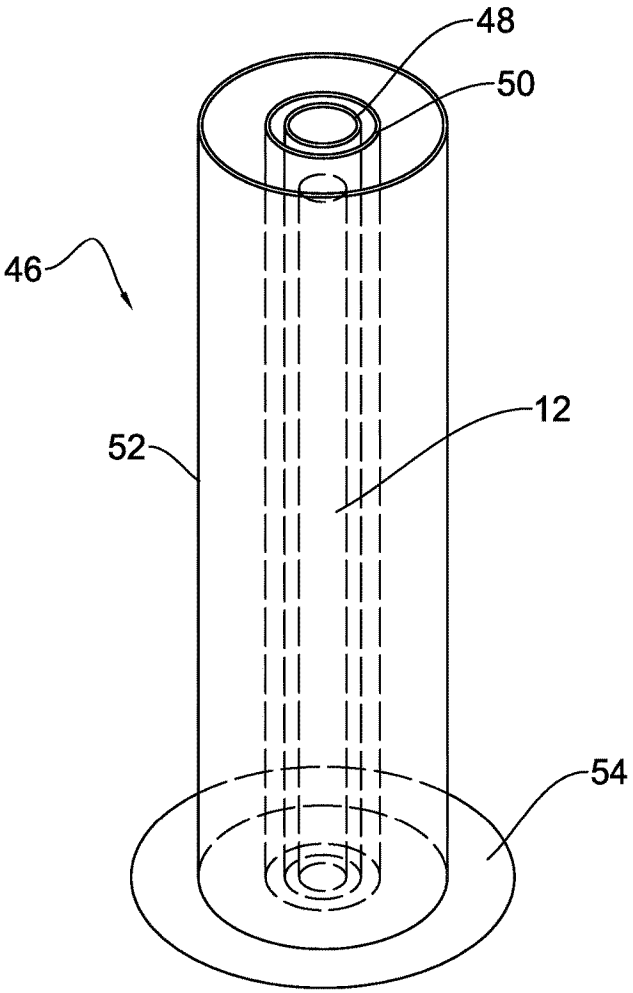
FIG. 7 is a perspective view of a fourth embodiment with hidden lines showing internal details.

It is worth noting that the method of this invention can be made to work when the shells are all comprised of the same material and of the same height, that height being chosen to slightly exceed the height of the monopole. FIG. 7 shows such an antenna 46. Monopole 12 is 18" long and is surrounded by three shells: innermost shell 48, intermediate shell 50, and outermost shell 52. Each shell 48, 50 and 52 uses the same printed copper pattern to obtain anisotropy. As before these are provided above a ground plane 54. Upon testing, VSWR of this antenna 46 provided similar bandwidth to the embodiment shown in FIG. 1.

Figure 8:
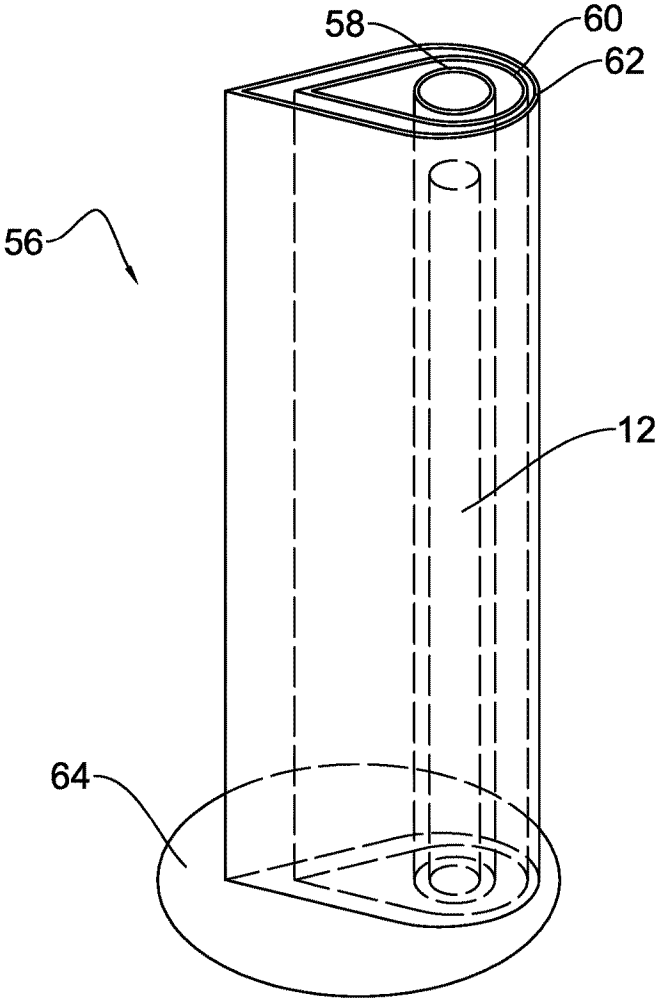
FIG. 8 is a perspective view of a fifth embodiment with hidden lines showing internal details.

FIG. 8 provides yet another alternate embodiment of an antenna 56 has an outermost shell 62 with a teardrop cross-sectional shape adapted for fluid flow around the antenna. Intermediate shell 60 is adapted to be in conformance with outermost shell 62. Innermost shell 58 is shown as having a circular cross-section, but it could be in conformance with intermediate shell 60 or any cylinder having a smooth closed cross-sectional curve. In this embodiment, innermost shell 58, intermediate shell 60, and outermost shell 62 are all the same axial length. This common length is sufficiently longer than monopole 12 to capture substantially all radiation. As before, antenna 56 includes a ground plane 64. This embodiment is expected to provide substantially the same broadened bandwidth as the previous embodiments.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An antenna capable of being joined to an antenna feed comprising:

a ground plane made from a conductive material joined to the antenna feed ground;

a monopole having an axis with a length extending perpendicularly from said ground plane having a first end positioned proximate and insulated from said ground plane and joined in communication with said antenna feed and a second end distal from said ground plane;

an innermost shell provided outside said monopole and spaced apart therefrom and extending longitudinally beyond the second end of said monopole, said innermost shell being in electrical contact with the ground plane, said innermost shell having a dielectric tensor having high permittivity in the direction parallel to the axis of said monopole and a low permittivity in the plane orthogonal to the axis of said monopole;

an intermediate shell provided outside said innermost shell and spaced apart therefrom, said intermediate shell being in electrical contact with the ground plane, said intermediate shell having a dielectric tensor having high permittivity in the direction parallel to the axis of said monopole and a low permittivity in the plane orthogonal to the axis of said monopole; and an outermost shell having perimeter approximately equal to the length of said monopole, and positioned outside said intermediate shell and spaced apart therefrom, said outermost shell being in electrical contact with the ground plane, said outermost shell having a dielectric tensor having high permittivity in the direction parallel to the axis of said monopole and a low permittivity in the plane orthogonal to the axis of said monopole.

2. The apparatus of claim 1 wherein said outermost shell comprises:

an array of dielectric rods parallel to said monopole, each said rod being positioned much less than one wavelength of the maximum operating frequency away from adjacent rods, each said rod having a length of at least 25 times its mean diameter and each rod being made from a material having a dielectric constant greater than 30.

3. The apparatus of claim 2 further comprising structural means for holding said array of dielectric rods in position about said intermediate shell.

4. The apparatus of claim 1 wherein at least one of said innermost shell, said intermediate shell, and said outermost shell is parallel to but not coaxial with said monopole.

5. The apparatus of claim 4 wherein said outermost shell has a cross-sectional shape having reduced fluid drag.

6. The apparatus of claim 1 wherein said innermost shell, said intermediate shell, and said outermost shell all have the same length and extend longitudinally beyond the second end of said monopole.

7. The apparatus of claim 1 further comprising a fill material positioned between said outermost shell and said intermediate shell, said fill material being transparent to electromagnetic radiation utilized by the antenna.

8. The apparatus of claim 1 wherein said innermost shell is made from a material having a dielectric tensor of the form:

$$\bar{\varepsilon} = \begin{pmatrix} \varepsilon_{xx} & 0 & 0 \\ 0 & \varepsilon_{yy} & 0 \\ 0 & 0 & \varepsilon_{zz} \end{pmatrix}$$

wherein $\varepsilon_{xx}=\varepsilon_{yy}=1$ and $\varepsilon_{zz}$ is between 8 and 11.

9. The apparatus of claim 1 further comprising a substantially solid dielectric material disposed between said innermost shell and said monopole.

10. The apparatus of claim 9 wherein the substantially solid dielectric material is a syntactic foam that is transparent to electromagnetic radiation utilized by the antenna.

11. The apparatus of claim 1 wherein at least one of said innermost shell, said intermediate shell, and said outermost shell is formed from a cylinder of rigid dielectric material having an array of conductive strips disposed on an outer surface thereof.

12. The apparatus of claim 1 wherein at least one of said innermost shell, said intermediate shell, and said outermost shell is formed from alternating longitudinal layers of alumina and low-k materials.

13. The apparatus of claim 1 wherein said intermediate shell has a length less than that of said innermost shell.

14. The apparatus of claim 13 wherein said outermost shell has a length less than that of said intermediate shell.

15. A kit for increasing the bandwidth of a monopole antenna with a ground plane comprising:

an innermost shell provided outside the monopole and spaced apart therefrom and extending longitudinally beyond the second end of the monopole, said innermost shell being in electrical contact with the ground plane, said innermost shell having a dielectric tensor having high permittivity in the direction parallel to the axis of said monopole and a low permittivity in the plane orthogonal to the axis of said monopole;

an intermediate shell provided outside said innermost shell and spaced apart therefrom, said intermediate shell being in electrical contact with the ground plane, said intermediate shell having a dielectric tensor having high permittivity in the direction parallel to the axis of said monopole and a low permittivity in the plane orthogonal to the axis of said monopole; and an outermost shell having perimeter approximately equal to the length of the monopole, and positioned outside said intermediate shell and spaced apart therefrom, said outermost shell being in electrical contact with the ground plane, said outermost shell having a dielectric tensor having high permittivity in the direction parallel to the axis of the monopole and a low permittivity in the plane orthogonal to the axis of the monopole.

16. The apparatus of claim 15 wherein said outermost shell comprises:

an array of dielectric rods parallel to said monopole, each said rod being positioned much less than one wavelength of the maximum operating frequency away from adjacent rods, each said rod having a length of at least 25 times its mean diameter and each rod being made from a material having a dielectric constant greater than 30.

17. The apparatus of claim 15 wherein at least one of said innermost shell, said intermediate shell, and said outermost shell is parallel to but not coaxial with the monopole.

18. The apparatus of claim 17 wherein said outermost shell has a cross-sectional shape having reduced fluid drag.

19. The apparatus of claim 15 wherein said intermediate shell has a length less than that of said innermost shell.

20. The apparatus of claim 19 wherein said outermost shell has a length less than that of said intermediate shell.

* * * * *